US005730052A

United States Patent [19]

Mather

[11] Patent Number: 5,730,052

[45] **Date of Patent: *Mar. 24, 1998**

[54] METHOD OF HIGH RESOLUTION SILK SCREEN PRINTING

[76] Inventor: Clifford L. Mather, 10865 Jennifer La., Boca Raton, Fla. 33428

[ * ] Notice: The term of this patent shall not extend beyond the expiration date of Pat. No. 5,497,699.

[21] Appl. No.: 613,361

[22] Filed: Mar. 11, 1996

Related U.S. Application Data

[63] Continuation-in-part of Ser. No. 346,073, Nov. 29, 1994, Pat. No. 5,497,699.

[51] Int. Cl.[6] ..... B41M 1/12

[52] U.S. Cl. ..... 101/129; 101/126

[58] Field of Search ..... 101/129, 126, 101/4

[56] References Cited

U.S. PATENT DOCUMENTS 4,214,522 7/1980 Bille ..... 101/129

4,789,621 12/1988 Knoth ..... 101/128.4

5,497,699 3/1996 Mather ..... 101/129

*Primary Examiner*—Stephen R. Funk

*Assistant Examiner*—Daniel J. Colilla

*Attorney, Agent, or Firm*—Malin, Haley, DiMaggio & Crosby

[57] ABSTRACT

A method for applying and reproducing an original visual image such as a computer generated image, an oil painting or photograph, onto various surfaces using silk screen ink techniques for a high resolution permanent image transformation, especially useful on objects having a course or toughened surface, such as a football, basketball, or the like, wherein an image is applied to a rough surface by an improved silk screening type method resulting in a high resolution image reproduced on the surface of a non-smooth material, and equally applicable to smooth surfaces such as industrial control panels and the like.

15 Claims, 1 Drawing Sheet

METHOD OF HIGH RESOLUTION SILK SCREEN PRINTING

Continuation-in-part of Ser. No. 08/346,073, filed Nov. 29, 1994, now U.S. Pat. No. 5,497,699.

BACKGROUND OF THE INVENTION

1. Field of the Invention

This invention relates to a method for silk screen printing on a wide variety of materials having various surface characteristics, for applying high quality reproduction of an oil painting, photograph, or corporate logo, and especially sports logos and images. Specifically, this invention is directed to a method of high resolution screen printing on various materials having smooth or non-smooth surface characteristics, resulting in a durable decorative design or reproduction having high dot and line resolution definition. The invention also teaches a method of process control for maintaining high quality, high resolution, silk screen printing.

2. Description of the Prior Art

The use of silk screen technology for providing reproductions of artwork and photographic representations on various surfaces is well known. Screen printing consists of pushing ink through tiny holes of a stencil, which is typically made of a fine nylon or polyester mesh. Selected areas of the screen are blocked out, either by screen filler, paper stencils, or photographic stencils, and consequently the ink is prevented from penetrating through the mesh to the paper below. By this procedure, complex images can be achieved, and a new screen is made for every change of color in the design—often as many as forty screens, and occasionally more.

Screen prints can be extremely large and with conventional prior art methods images have been reproduced in may different: ways; by drawing or painting onto the screen with liquid screen fillers; by cutting paper or fabric and laying them over the screen surface; or by photographic transfer. During the printing process new colors are applied individually to the substrate surface using successive screens, thereby building the image in successive steps.

Fabric is often decorated using silk screen techniques. Although fabric surfaces are quite amenable to silk screen techniques, certain other surfaces, based on their composition, hardness, texture, smoothness and other characteristics, are not widely used. Specifically, material having a rough surface with recessed portions is particularly difficult on which to apply silk screen designs since traditional ink formulations and application methods do not adequately coat, or maintain dot definition, thereby degrading the quality of the reproduction. Such materials are often used to make sports balls as well as being used for industrial control panels. Accordingly, there exists a need for a method of high resolution silk screen printing capable of reproducing high quality images on various surfaces including: rubber based materials (such as used in hockey pucks); expanded vinyl and cloth type laminates; cloth rawhide (such as found on a baseball); tennis ball covers; other sports balls; pressure sensitive vinyl and mylar; polyester and polycarbonate materials used in membrane circuits, industrial control panels, and computer panels; painted and coated metals; ceramic decals; styrene; polyethylene; MYLAR; foam board; paper board; displays; tyvec; glass; wood; and acid free paper or canvas as known and used in the fine arts.

Furthermore, past attempts at applying multi-colored images to material used to make sports balls resulted in cracking or flaking of the image during the assembly process in which the ball is turned inside out prior to final assembly or during inflation when the surface experiences slight expansion.

In the current sports world, memorabilia containing images of players, team designs, team logos especially for baseball, football and basketball, and trading cards, has become a large industry in itself.

The present invention is directed to overcoming disadvantages existing in the prior art and relates to the reproduction of images including players, designs, wording and logos which may be based on an oil or acrylic type painting or photograph, or computer generated artwork or images, such that a reproduction of the image is transferred onto the surface of any of the aforementioned materials, or to other surfaces such as industrial or appliance control panels and switches.

In the specific embodiment shown in this invention, the applicant has invented a method to provide a high quality image on various surfaces, or portions thereof, such as a vinyl or leather surface using silk screen techniques. However, the instant invention is equally applicable to producing high quality images on a wide variety of surfaces including industrial panels and the like. The method is also usable for other sports objects such as basketballs or other vinyl, leather, or other synthetic type materials including non-sports objects. The method is suitable for a wide variety of materials and smooth as well as coarse surfaces. The instant method further defines process control steps for insuring and maintaining high resolution, high quality, silk screen printing on a wide variety of surfaces.

SUMMARY OF THE INVENTION

A method for applying and reproducing an original visual image such as a photograph or computer generated image onto various surfaces using silk screen type techniques for a high resolution permanent image transformation, especially useful on objects having a coarse or roughened surface. The original image is either computer generated, or optically scanned into a computer, wherein image dots which comprise the image may be adjusted for color enhancement and color adjustment from which computer generated films are made. A color proof may be generated using a suitable printing means, such as an ink jet printer or digital press.

The use of a computer and computer graphic enhancement software is an important aspect of the instant method for creating high resolution and thus, high quality silk screen images and/or reproductions. Accordingly, original art is generated using computer graphics software, or scanned into a computer such that the image is digitized and stored. Once stored, the digitized image may be totally or selectively adjusted (e.g. individual dot shapes and/or sizes may be adjusted) for yielding the highest quality results possible. Specifically, adjustments to the digitized image are directed to making the dot sizes compatible with the silk screen materials including the mesh, ink and substrate.

The particular mesh selected is based on the image, ink, and the material forming the printing substrate. Typically, the mesh may consist of mono-filament, polyester, nylon, etched metal, calendared (pre-stretched) or silk.

The surface of the specific material may be initially prepared with an acetone type solvent to open the pores of the material (hereafter referred to as the work-piece). The work-piece may then be wiped with a light pressure such that the excess solvent removed. The work-piece may then be air dried individually for a predetermined length of time.

After air drying, the work-piece may be re-cured for a given time at a given temperature. In applications involving leather and the like for the fabrication of sports balls, the work-piece may be cut or trimmed as required, after which the material may be seasoned for 12 to 14 hours, meaning the material is allowed to dry, for the removal of excess moisture from the work-piece material, in a controlled environment prior to any printing process.

For the silk screen process, a series of flexible, stretchable ink formulations are selected as to types, mixtures, viscosity and reducers, for use with a high mesh count silk screen. The high mesh count silk screen cannot be used with conventional inks so different ink formulations are required for the proper results. According to the instant method, inks are formulated to obtain optimal thixotropic properties for use with high mesh count silk screens. The present invention contemplates the use of water based ink, ceramic ink, epoxy based ink, enamels, lacquer, plastisol, and any other suitable color formulations. The type of ink selected depends on the characteristics of the material to be printed upon. The silk screen mesh is mounted in a frame under high tension. The invention contemplates that a different silk screen mesh may be used for each color.

The enhanced image is transferred to each silk screen by light exposure on photo-sensitive emulsions on the silk screen.

The silk screen material is selected with mesh count being of prime importance. The silk screen material is stretched and may be chemically prepared with the proper chemicals relative to the proofs. Each silk screen is then prepared with the proper lighting and time exposure, including post cure screen and blockout. Each silk screen is seasoned before production. The screen exposure is controlled by color, by area, flash background, light and proper exposure. The silk screen frames are critical to obtain high tension (newtons/cm) of the silk screen mesh material.

The work-piece is positioned under one silk screen and the silk screen ink is applied using an ink squeegee having a certain durometer value and sharpness. Once the ink image has been transferred onto the work-piece surface, the ink transferred image is cured at a certain temperature for a predetermined amount of time. There may be an additional subsequent air curing time after which the material may be further die cut for its ultimate use.

The work-piece may then be hand powdered to act as a dry lubricant if the work-piece is to be stitched together with other cooperating pieces and formed, for example, into a football by applying heat, if necessary, for turning the work-piece inside out without affecting the image.

It is an object of this invention to provide an improved method for providing high resolution artwork using silk screen ink techniques to various smooth and non-smooth surfaces.

It is another object of this invention to provide an improved method of high resolution silk screen printing that allows for a permanent high quality reproduction artwork mounted on various surfaces.

And yet still another object of this invention is to allow the use of objects such as footballs or basketballs to receive a permanent art form for use as memorabilia.

A further object of the instant invention is to provide a method whereby materials having rough surfaces may be prepared and decorated with a high quality multi-colored reproduction of an image using high mesh count/high tension silk screen techniques and specific ink formulations.

Still another object of the present invention is to provide a method of printing whereby an image is applied onto a work-piece as to allow turning of the material containing the image such that the image does not crack or flake.

DESCRIPTION OF THE PREFERRED EMBODIMENTS

Figure 1:
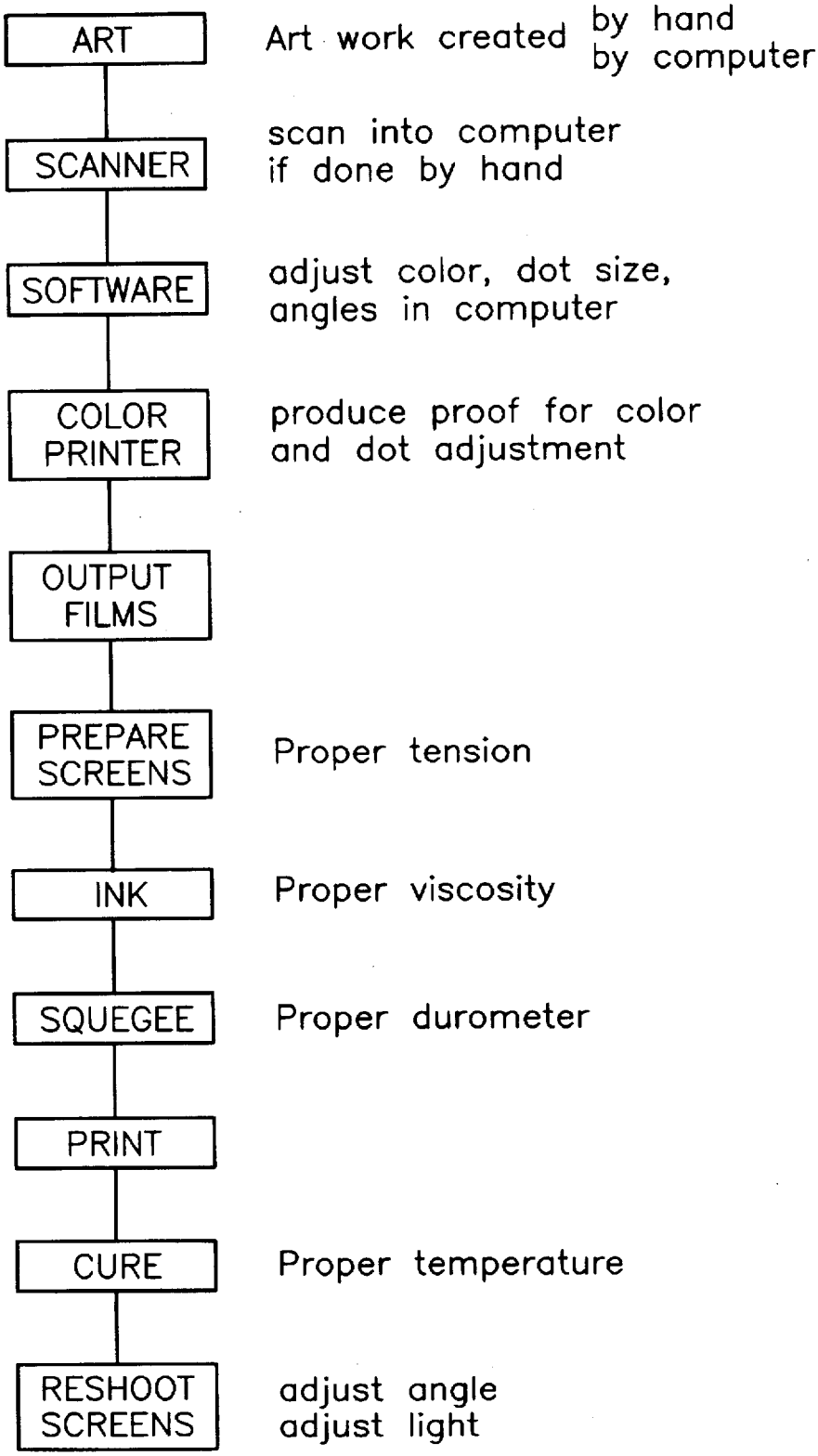
FIG. 1 is a flowchart of the method of the present invention.

This would be the preferred embodiment of the invention. A material having a non-smooth surface for having artwork mounted on a portion of said surface is selected. The original artwork is selected for transfer. It is important to note that the original artwork may be an existing work, or may be an original computer generated work, developed specifically for this application. The original artwork is photo-processed, or reproduced, into a transparency, which is then scanned into a computer for storage and which allows the computer to make adjustments for color, dots, line screen, angle of screening and number of images. Adjustments to the scanned image are preferably made using image processing software that utilizes the random dot method of image modification for enhancing image quality, also known in the art as the stochastic, or frequency modulated methods of image modification. Once the final image is selected on the computer a film positive emulsion up is then produced for each color of the process colors used in silk screen process, such as magenta, yellow, black and cyan. One film, typically a positive, is created for each color. Each film may be adjusted by dot etching techniques. Films are then test shot onto test screens with a set exposure to light using photo-setting emulsions such that portions of the screen may be masked by each film. The image is then test printed on a surface to proof the film's colors and screen exposure. Adjustments are made to screens such as angular placement on screen, and amount of light exposure for each color. In addition the ink formulations are adjusted and reformulated as necessary. Some areas may receive two to four different exposures within the same color using masking films to achieve the desired results. The design is proofed again to test film's exposure and color. These steps may be repeated in order to achieve the highest quality reproduction of the original artwork.

The vinyl or leather material, such as expanded material used in footballs or basketballs or other products, may require surface preparation including: wiping with a solvent with light pressure; air drying the material individually; curing the material at a predetermined temperature for a predetermined amount of time (depending upon the material used); cutting the material; and obtaining squared stock with edges marked for controlled registration. Depending on the application, the material may then be air seasoned for twelve to fourteen hours, in a controlled environment prior to printing, to allow the removal of excess moisture. Leather material is typically seasoned in an air conditioned environment at room temperature (approximately 72–78 degrees Fahrenheit and 50% relative humidity).

Also prior to the actual silk screen process, various ink formulations must be arrived at. The instant process may be practiced using a wide variety of ink formulations including: water based ink; ceramic ink; epoxy; enamels; lacquer; plastisol; and vinyl based ink. The ink used must have a predetermined mixture viscosity and reducer based on the mesh size of the silk screen of at least one color. In an alternate embodiment, ultra-violet sensitive inks are used such that ink applied to the material's surface may be cured using ultra-violet radiation. The ink is mixed for various process colors and colors determined using a matching system.

A. PREPARATION OF SILK SCREENS

The silk screen, having a mesh count of between 15 and at 600 or more, is set up in a highly tensioned and stretched configuration in a diamond chase type high tension frame. In addition, mesh thread diameter is selected for the particular application. Once the inks are selected and prepared, the screen receives one color ink which is transferred by the printing process in which the screen contacts the work-piece and the ink is transferred by a squeegee-like action through the silk screen with controlled squeegee pressure, which pressure shall be determined depending upon the silk screen, ink, and image characteristics. The application of proper squeegee pressure is critical to producing a high quality image reproduction. The high mesh count screen and use of an optimal ink optimize surface coverage by allowing the ink to penetrate into the recessed areas of the surface thereby yielding high dot resolution. The screen itself is stretched, with a predetermined amount of tension (newtons/cm), and chemically prepared. In addition, the screen is exposed by light exposure for a predetermined time exposure of light units. The screen may be post-cured with sunlight or ultra-violet light. The mesh of the screen is prepared using a reducer blockout over special areas.

After the print is made with a special squeegee the work-piece having images is then cured at an elevated temperature for a predetermined amount of time. It is further air cured as needed for a predetermined amount of time. Finally, in an application using leather material for making a sports ball, the work-piece may be powdered to act as a dry lubricant which allows the die cut work-piece to be turned inside out. For example, when creating a football, the work-pieces are stitched together and heat may be applied to soften the vinyl or leather material for turning. The lubricating powder is selected to be cornstarch free.

Example

The work-piece is prepared by wiping a leather or synthetic vinyl material, that will be used to make a football, with light pressure using a solvent. The work-piece is dried 3 to 6 hours. The work-piece is also cured at 180 degrees F. for two minutes.

The material is cut in squared stock with edges marked for controlled registration.

The work-piece is then seasoned for 12 to 14 hours at conditioned room temperature, approximately 72 degrees Fahrenheit and 50% relative humidity, prior to printing to allow the removal of excess moisture.

B. PREPARATION OF INKS

The ink formulations are selected and a vinyl ink is used with four basic process colors, yellow, magenta, cyan and black. In addition to process colors, colors may be formulated using the Pantone Matching System. Colors are mixed into various percentages and may include half tone base and clear extended base to achieve optimal thixotropic properties. Pressure is a critical factor in the printing process in that too little pressure will not print all the dots through any image which causes voids in that particular color, and too much pressure will make the dots grow or become larger which causes a loss of definition in the design. Thus, pressure is highly critical in high resolution printing. The combination of silk screen mesh count, mesh thread diameter, ink formulation, and squeegee pressure taught in this invention results in high quality, high definition, image reproduction on a variety of non-smooth or rough surfaces.

The silk screen is selected with a monofilament or polyester mesh, using a high tension diamond chase type frame with the mesh count between 15 and 510, or higher. The silk screen is stretched with a proper tension in newtons/cm. It is expected that high tensioning forces may be desirable. In order to create the screen, the time exposure of light between 10 and 995 light units may be used. A suitable light source, such as a Halide light source lamp using a programmable integrator, is preferably used to measure the time exposure. The screen may be cured with sunlight or ultraviolet light. The mesh is prepared with a reducer.

During the actual print process a squeegee is selected having a durometer reading between 40 and 150 and a predetermined sharpness. Once the work-piece receives the printed image it is cured at a predetermined temperature for a predetermined amount of time. The work-piece is then air cured for a predetermined amount of time.

In certain applications the material is further die cut to get it ready to be sewn together, as when fabricating a football. When stitched together, the partially assembled ball exists inside out (i.e. the stitching is on the outside while the multi-colored image is on the inside). Therefore, it is necessary to turn the ball inside out, as is required by the ball making process, without damaging the silk screen reproduction. Thus, a cornstarch-free powder may be applied by hand to act as a dry lubricant, and heat may be applied to soften and allow the ball to be turned inside out without affecting the image. Finally the balls are stitched together resulting in a completed ball, such as a football, with the stitching in the interior and a multi-colored image reproduction on the exterior surface.

What is claimed is:

1. A method of silk screen printing, for applying a high resolution reproduction of an image including the steps of:

digitizing an image and storing said image in a computer memory;

generating a film negative or positive of the image for each process color and matching system color, including magenta, yellow, black, and cyan;

photo-chemically producing high mesh count per centimeter silk screen stencils for each process color, by mounting said silk screen stencils in individual diamond chase type frames such that each of the stencils is highly tensioned within a frame by a force of between 1 and 100 newtons, and using photo-setting emulsions exposed to a light source;

preparing ink formulations having thixotropic properties suitable for use with high mesh count silk screen stencils for each process color and matched color including magenta, yellow, black, and cyan, using mixtures of half-tone base and clear base;

loading a silk screen printing machine with one of the prepared ink formulations and one of said diamond chase frames having a silk screen stencil mounted therein;

reproducing at least a portion of said image by applying a selected ink formulation by forcing the ink through the silk screen stencil with a squeegee at a controlled pressure such that said ink formulation coats both raised and recessed portions of the work-piece application surface;

repeating the ink application procedure for each color and silk screen stencil combination thereby resulting in a multi-colored reproduction of the image on the work-piece application surface;

curing the work-piece resulting in a finished work-piece having an application surface with a reproduced image thereon.

2. A method of silk screen printing according to claim 1, wherein said work-piece application surface comprises a non-smooth surface.

3. A method of silk screen printing according to claim 1, wherein said work-piece application surface comprises leather material.

4. A method of silk screen printing according to claim 1, wherein said digitized image is enhanced using image enhancing software utilizing a random dot enhancement method.

5. A method of silk screen printing according to claim 1, wherein said ink comprises ultra-violet ink that is cured using ultra-violet radiation.

6. A method of silk screen printing according to claim 1, wherein said ink is water based ink.

7. A method of silk screen printing according to claim 1, wherein said ink is ceramic based ink.

8. A method of silk screen printing according to claim 1, wherein said ink is epoxy based ink.

9. A method of silk screen printing according to claim 1, wherein said ink is enamel.

10. A method of silk screen printing according to claim 1, wherein said ink is lacquer.

11. A method of silk screen printing according to claim 1, wherein said ink is plastisol.

12. A method of silk screen printing for applying a high resolution reproduction of an image including the steps of:

producing a color transparency of an image by photographic reproduction;

digitizing the image by scanning the transparency into a computer memory;

enhancing the digitized image using image processing and enhancing software;

generating a film negative or positive of the image for each process color and matched color, including magenta, yellow, black, and cyan;

photo-chemically producing high mesh count silk screen stencils, by treating the silk screen material with a photo-setting emulsion, masking the silk screen material with a film positive and exposing the silk screen material to ultra-violet radiation, and curing with exposure to ultra-violet radiation, resulting in high mesh count silk screen stencils, for each color;

mounting said silk screen stencils in individual high tension diamond chase type frames such that each of the stencils is stretched within a frame;

preparing ink formulations having optimal thixotropic properties for each process color and each matched color including magenta, yellow, black, and cyan;

test printing an image utilizing said silk screen stencils and said ink formulations;

improving print quality and color reproduction, by adjusting silk screen angular placement, ultra-violet exposure including the use of masking films, and reformulating inks to achieve the highest quality reproduction of the original image;

preparing a work-piece having an application surface, by applying a solvent;

loading a silk screen printing machine with one of said ink formulations and one of said diamond chase type frames having a silk screen stencil mounted therein;

reproducing a portion of said image by applying a selected ink formulation by forcing the ink through the silk screen stencil with a squeegee such that said ink formulation coats both raised and recessed portions of said application surface;

repeating the vinyl ink application procedure for each color and silk screen stencil combination thereby resulting in a four color process reproduction of the image on the work-piece surface.

13. A method of silk screen printing according to claim 12, further including the steps of:

curing the work-piece in ambient conditions;

applying a cornstarch free powder to the work-piece surface containing the multi-colored image for functioning as a lubricant;

trimming the work-piece and stitching the work-piece together with other cooperating pieces to form a sports ball;

heating the material to soften, thereby allowing the sports ball to be turned inside out without affecting the applied image resulting in a finished sports ball having a rough exterior surface with a four color reproduction of the image thereon.

14. A method of silk screen printing according to claim 12, wherein said work-piece comprises leather material.

15. A method of silk screen printing according to claim 12, wherein said work-piece comprises and industrial control panel.

* * * * *